United States Patent [19]

Brandriff

[11] Patent Number: 5,040,590

[45] Date of Patent: Aug. 20, 1991

[54] METHOD OF COOLING A CENTRIFUGAL CASTING MOLD

[76] Inventor: Robert C. Brandriff, P.O. Box 600, Brooklyn, Conn. 06234

[21] Appl. No.: 554,917

[22] Filed: Jul. 20, 1990

[51] Int. Cl.[5] ..... B22D 27/04; B22D 13/00; B22D 13/10

[52] U.S. Cl. ..... 164/118; 164/127; 164/297; 164/348

[58] Field of Search ..... 164/118, 127, 297, 342

[56] References Cited

U.S. PATENT DOCUMENTS

| | | | |
|---|---|---|---|
| 3,658,116 | 4/1972 | Hunt | 164/485 X |
| 3,716,094 | 2/1973 | Fuminier | 164/297 X |
| 4,671,338 | 6/1987 | Otsuka et al. | 164/348 X |
| 4,858,671 | 8/1989 | Hesterberg et al. | 164/127 X |

FOREIGN PATENT DOCUMENTS

| | | | |
|---|---|---|---|
| 62-39057 | 8/1987 | Japan | 164/127 |
| 194274 | 5/1967 | U.S.S.R. | 164/127 |

*Primary Examiner*—J. Reed Batten, Jr.
*Attorney, Agent, or Firm*—Lane, Aitken & McCann

[57] ABSTRACT

A mold used in centrifuge casting is cooled by taking advantage of inherent characteristics of the centrifugal casting process, and in particular the shape of the remaining sprue. The sprue has a conical profile and a conical depression formed by a vortex which results from the spinning mold. The cooling apparatus comprises a housing and plunger which engage the surface of the sprue and draw heat from the mold. Thermal conduction from the hot metal through the runners and sprue to the cooling head allows a mold to cool faster than traditional methods.

5 Claims, 2 Drawing Sheets

METHOD OF COOLING A CENTRIFUGAL CASTING MOLD

BACKGROUND OF THE INVENTION

This invention relates to an apparatus for cooling molds used in white metal casting and more particular for white metal casting which employs a centrifuge to assist in the delivery of molten metal to the desired mold cavity. White metals and particularly tin base bearing metals and their various alloys are commonly used in the production of costume jewelry. These inexpensive metals are relatively soft and malleable which makes the metals easy to handle, shape and form into jewelry. Further, tin and its alloys have low melting points, are highly fluid when molten and do not easily corrode. One method of casting jewelry made of these alloys is to introduce molten metal into a rapidly spinning mold. This method, known as centrifuge casting, takes advantage of the centrifugal force exerted by a turning wheel to deliver molten metal to the mold cavity. Molten metal is introduced at the center of a rapidly spinning mold and the centrifugal force causes the metal to move radially to the periphery of the mold. The inertial forces of rotation distribute the molten metal into mold cavities and the centrifugal action increases the pressure in the mold cavities insuring that the molten metal completely fills the cavities. It is an effective way to ensure that the intricate cavities of a design are filled and no interstitial voids remain after pouring molten metal into a mold. A problem encountered with this type of casting however is the tendency of the molds, which are typically constructed of a vulcanized rubber, to become too hot when the same mold is used to make repeated castings. When the rubber mold material becomes too hot it causes the castings to stick to the mold surface. In addition the rubber mold material may degrade. Standard casting technique allows for the molds to air cool between casts so that an acceptable equilibrium temperature can be maintained. Cooling the interior surfaces of the rubber mold is difficult because rubber has a low thermal conductivity and as such is an excellent insulator. Because of problems with heat, a significant period of time must be allowed for the molds to cool before a new cast may be made. During this time other molds may be used by the casting operator but it is sometimes desirable to make multiple use of one mold that is more popular than the others. This problem could be solved by purchasing more molds of the more popular casting, but the cost of the molds makes this solution uneconomical, particularly since the popularity of the castings can vary from time to time.

Accordingly, it is the object of the invention to provide a method of reducing the time it takes for a mold to cool and, as a result, optimize the time available for a mold to be used.

BRIEF DESCRIPTION OF THE INVENTION

Centrifugal casting methods employ molds that are rotated at high speeds on a wheel. The centrifugal forces radially move molten metal that is introduced to a basin in the mold via a fill tube at the center of a spinning wheel to fill the mold. At the location that the molten metal is introduced to the spinning mold, not all of the metal passes into the pouring basin and through the gates to the mold cavities but an excess hardens in the fill tube. This excess metal is generally referred to as the sprue. Preferably in the system of the invention, molten metal reaches the mold through a fill tube that is shaped with a slight internal taper. The tapered design facilitates the removal of the supply tube from the portion of the sprue formed by the removal of the supply tube after the metal has hardened. After the metal has hardened and the fill tube is removed from the basin area, there remains a conical shaped sprue which projects externally from the basin on the axis of the mold. The conical sprue also has an inverted concave conical surface due to the vortex created by the spinning mold. The mold which is still hot, is removed from the centrifuge wheel and positioned under the cooling apparatus of the invention. When the mold is in position, an annular housing and cooling head are lowered to engage the external sprue. The housing is shaped to fit and engage the exterior surface of the sprue and cools the sprue. The invention also takes advantage of the inverted concave conical depression in the sprue formed by the rotation of the mold by engaging its concave surface with the cooling head, which is provided with a mating conical shape. The housing and cooling head are able to engage a variety of sprue sizes that will differ according to the amount of excess metal purposely introduced to the mold to ensure that the mold cavities are filled. A cooling fluid is pumped through the housing and conical head to draw heat from the metal which thereby cools the interior surfaces of the mold.

The housing and cooling head, which engage the sprue, cools the metal that has hardened and by thermal conductivity draws the heat radially from the mold cavities. The cooling of the casting within the mold also cools the rubber material defining the mold cavities. The work surface on which the mold is positioned during the cooling cycle can also be fitted with conduits that can carry coolant and accelerate cooling of the exterior surfaces of the mold. The use of the apparatus of the invention allows the time that is normally required to achieve satisfactorily cooling of the mold to be significantly reduced Accordingly, the time between castings using a single mold can correspondingly be reduced. Thus, the cooling system helps speed the process of centrifugal cast molding by allowing a much higher casting cycle rate thus achieving greater efficiencies.

An additional advantage of the invention is that forced cooling of the molds, in the manner of the invention, removes heat from the cast metal immediately after the mold has been poured, thereby limiting the opportunity for heat to be transmitted to and built up in the rubber mold material.

DETAILED DESCRIPTION OF THE PREFERRED EMBODIMENTS

Figure 1:
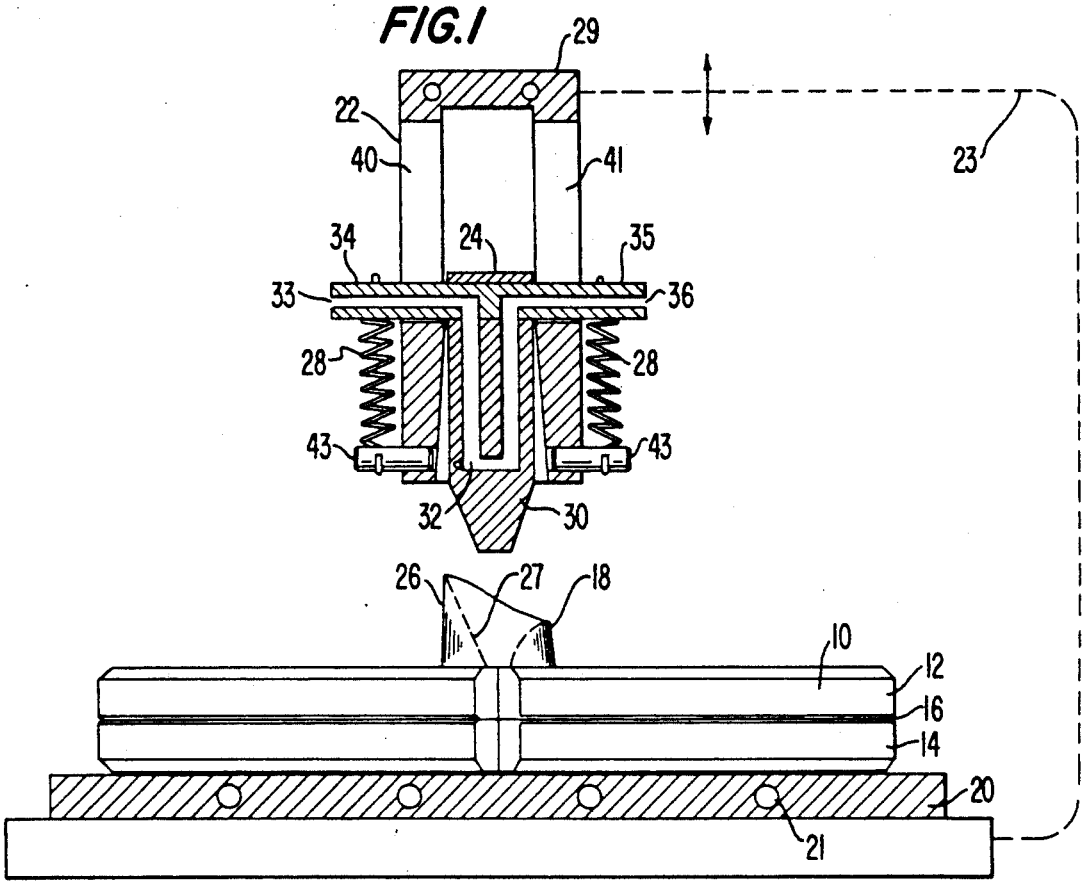
FIG. 1 is a sectional view of the mold cooling station of the invention shown in elevation.
Figure 3:
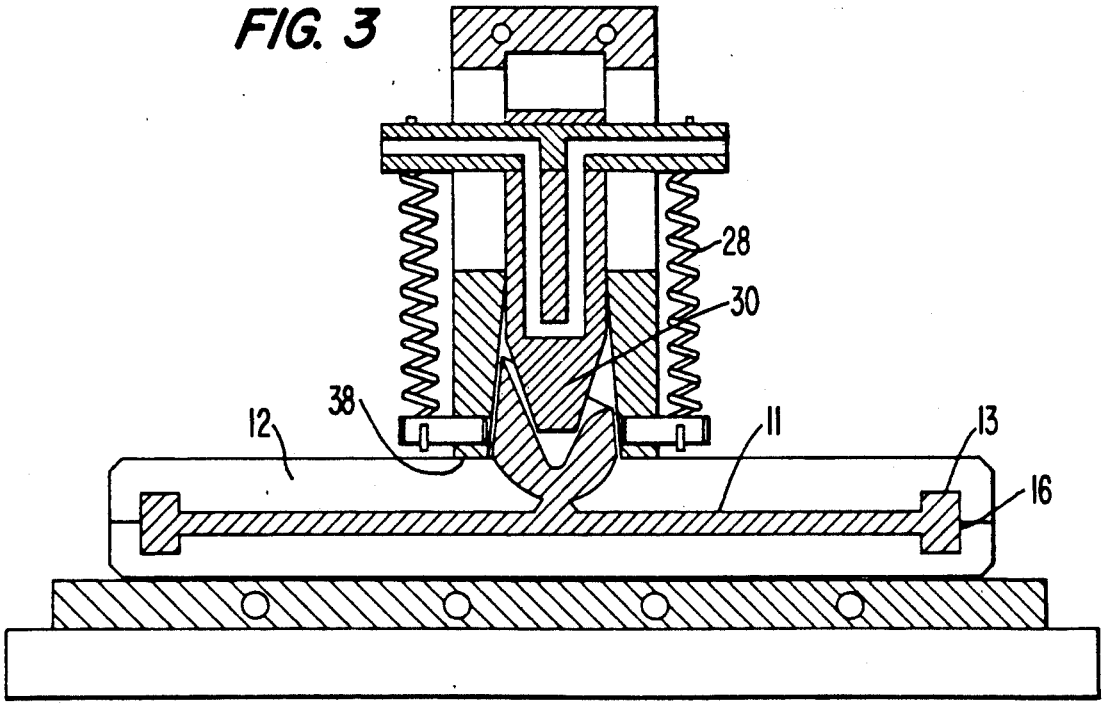
FIG. 3 is a sectional view of the cooling station of FIG. 1. showing the cooling head in engagement with a sprue on a mold being cooled.

In the cooling station shown in FIG. 1 a mold 10 containing a hot solidified casting is placed on a work platform 20. The circular rubber mold 10 has been filled with molten metal and spun at high speeds on a centrifuge wheel. Typically, a tin based metal alloy or other metal or alloy with a melting point at a temperature suitable for casting with a rubber mold is heated to a liquid state and introduced through a fill tube into the spinning mold. The mold is rotated to reach speeds of over 500 R.P.M. Centrifugal force causes the molten metal to travel down runners or gates 11 to the mold cavities 13 as shown in FIG. 3. The mold 10 comprises two separable parts, an upper cope 12 and lower drag 14 separated by lateral transverse interface 16. The molten metal quickly and completely hardens after pouring. The complete casting process takes approximately 30 to 45 seconds, with the last 10 to 15 seconds of spin time allowed for the metal to solidify. A conical shaped sprue 18 which consists of excess or waste metal remains exposed after the fill tube which preferably has an internal taper, is removed. An internal taper facilitates the removal of the fill tube from the sprue 18 after the metal has hardened. After removal from the spinning apparatus, the mold is positioned on the work platform 20 at the cooling station to cool the mold so the metal castings can be removed. The work platform incorporates conduits 21 in which a cooling medium such as water flows and contacts the bottom of the drag 14 of the mold and draws heat from the mold.

Figure 2:
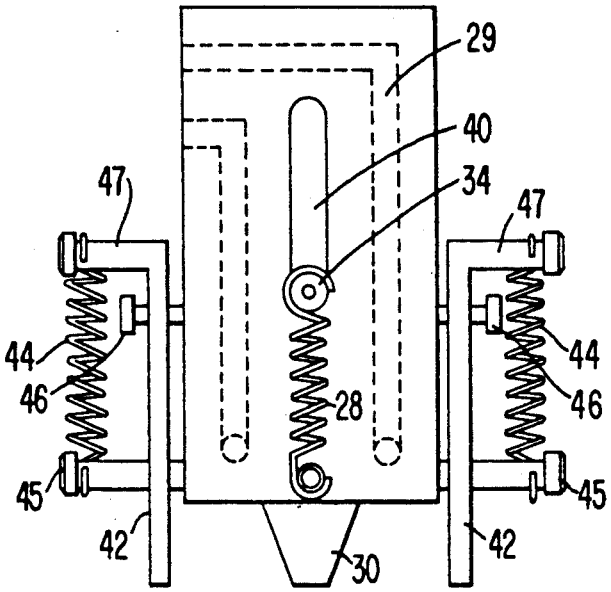
FIG. 2 is a side view in elevation of the housing and cooling head employed in the cooling station shown in FIG. 1.

When the mold is in position on the work platform 20, a housing 22 and plunger 24 are lowered to engage sprue 18. The housing and plunger assembly are connected to and positioned above the work station by a support 23, which can reciprocally move the housing 22 with the plunger 24 up and down into and out of engagement with the sprue. The housing 22 has a conical cavity which is shaped to mate with the exterior conical surface 26 of sprue 18. The housing's internal surface has a tapered shape that matches that of the fill tube. Any size sprue that has been formed by the fill tube can fit into the housing. Within the walls of the housing are conduits 29, which transport a cooling fluid such as water through the housing for the purpose of rapidly drawing heat from the sprue. The inner cylindrical plunger 24 is slidably supported in the housing 22 and springs 28 resiliently bias the plunger 24 downwardly and allow the plunger to adjust to different sprue heights. The springs 28 apply pressure to the concave conical surface 27 of the sprue formed naturally by the rotation of the mold during the casting process. Plunger 24 has a cooling head 30 in the shape of a truncated cone and is designed to maximize contact with the concave conical surface 27 of sprue 18 formed by the spinning vortex of molten metal. The shape of the cooling head 30 permits it to fit a variety of sprue sizes. Conduit 32 within the plunger 24 carries cooling fluid flowing continuously from inlet 33 through extension 34 and draws heat from the head 30. The cooling fluid exits the plunger 24 through extension 35 at outlet 36. The housing and plunger structure restricts movement of the cooling head 30 to a vertical direction relative to the housing 22. The extensions 34 and 35 extend through vertical slots 40 and 41 in the housing to permit the vertical sliding motion of the plunger 24 relative to the housing. Extensions 34 and 35 which project through the slots 40 and 41 restrict movement of the plunger to that of the slot length. The springs 28 are attached at their upper ends to the extensions 34 and 35 and are attached at their lower ends to studs 43 mounted in the housing 22. As shown in FIG. 2, spring loaded bars 42 are slidable mounted on the housing 22 to engage the cope 12. The sliding motion of the bars 42 is guided by studs 45 and 46, which extend through slots in the bars 42 and are mounted in the housing 22. Springs 44 stretch between studs 45 and arms 47 extending outwardly from the upper ends of the bars 42. When the housing and the plunger 24 are lowered to engage the sprue, the bars 42 will slide relative to the housing 22 and the springs 44 will press the bars 42 against the top of the cope 12. The force exerted by springs 44 on the top of the cope 12 facilitates the disengagement of the cooling apparatus from the sprue after the cooling cycle is completed.

FIG. 3 shows the cooling apparatus as depicted in FIG. 1 in contact with sprue 18. In operation, the housing 22 and plunger 24 are lowered together until the housing 22 is in contact with the exterior conical profile 26 of the sprue 18. When the apparatus is lowered, the head 30 will engage the inner conical concave surface 27 of the sprue and, depending on the depth of the vortex and height of the sprue, will resiliently retract inside the housing. The springs 28 apply pressure to the conical surface 27 of the sprue via the head 30. When the apparatus is engaged, the housing 22 and the head 30 apply low temperature sinks to both the interior depression and exterior conical profile of the sprue. Since the sprue is comprised of hardened metal it has a high degree of thermal conductivity and is an efficient vehicle to draw heat from the extremities of the mold through the runners. By conduction, both the metal within the mold and the surfaces of the rubber mold in contact with the metal are cooled. Heat is transferred from the mold at a faster rate thereby substantially reducing the time for cooling of the mold. Thus, a mold can be prepared for reuse after a shorter time interval.

Figure 4A:
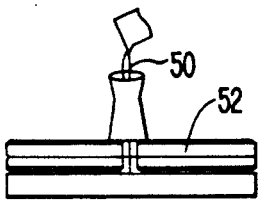
FIG. 4*a* is a view in elevation of molten metal being poured into a mold illustrating the first step in a casting and cooling process in accordance with the invention.
Figure 4B:
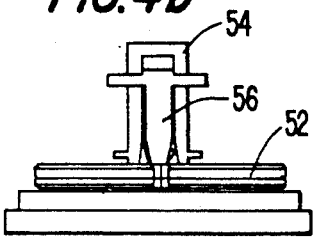
FIG. 4*b* is a sectional view of a cooling station that represents a second step in the process.
Figure 4C:
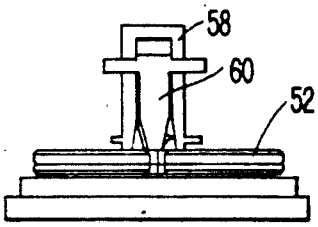
FIG. 4c is a sectional view of a second cooling station that illustrates a third step of the process.

FIGS. 4a, 4b and 4c show an assembly line operation using the cooling apparatus of the invention. The first step shown in FIG. 4a is pouring the molten metal 50 into a spinning mold 52 at the casting station. Pouring the molten metal into the mold and allowing the metal to solidify takes about 30 seconds. Next, after the metal has solidified, the mold 52 is positioned at a first cooling station as shown in FIG. 4b and engaged by the housing 54 and cooling head 56 constructed as described with reference to FIGS. 1-3. After about 30 seconds the mold is removed from the first cooling station and positioned at a second cooling station as shown in FIG. 4c for an additional 30 seconds. The sprue is again engaged by a second housing 58 and second cooling bed 60 also constructed as described with reference to FIGS. 1-3. The castings are then removed and the mold is ready for reuse. The entire process takes less than 2 minutes. Using two cooling stations in sequence allows a total cooling period of 60 seconds. By providing a cooling cycle extending effectively over 60 seconds, the number of molds required for the molding process in continuous operation is reduced from eight molds to three or four molds.

The above description is of a preferred embodiment of present invention is considered illustrative rather than limiting. It is contemplated that various modifications can be made without departing from the spirit and scope of the present invention, which is defined in the appended claims.

I claim:

1. A method of cooling a mold used in centrifugal metal casting comprising forming an exterior hardened sprue on a casting within said mold with an inverted conical depression forming said depression as a vortex in said sprue by rotating said sprue as said sprue hardens, cooling the metal contained therein by engaging said inverted conical depression with a head shaped to engage said conical depression, and thermally conducting heat from said mold through said sprue and said head.

2. A method of centrifugal casting comprising pouring molten metal into a mold, spinning said mold while said molten metal hardens to form a sprue protruding from said mold, positioning said mold under a cooling head, engaging said sprue with said head to cool said mold by thermal conduction, then positioning said mold under a second cooling head, then engaging said sprue with said second head to cool said mold by thermal conduction with said second head.

3. A method as recited in claim 2, wherein said sprue defines an inverted conical depression formed by the spinning of said mold while said molten metal hardens, and wherein said head is conically shaped to approximately mate with said conical depression.

4. A casting method comprising spinning a mold while pouring molten metal into a central entrance to said mold, allowing said metal to harden while spinning said mold to form a casting in said mold with a sprue protruding from said mold, said sprue having a conical depression caused by the spinning of said mold, engaging said conical depression with a thermally conducting head conically shaped to approximately mate with said inverted conical depression, and thermally conducting heat from said mold through said sprue and said head.

5. A method as recited in claim 4 further comprising engaging an exterior annular surface of said sprue with a housing having an annular surface shaped to mate with said exterior surface and thermally conducting heat from said mold and through said sprue and said housing.

* * * * *